US011508568B2

(12) United States Patent
Takeuchi et al.

(10) Patent No.: US 11,508,568 B2
(45) Date of Patent: Nov. 22, 2022

(54) EXCIMER LAMP

(71) Applicant: HAMAMATSU PHOTONICS K.K., Hamamatsu (JP)

(72) Inventors: Hiroki Takeuchi, Hamamatsu (JP); Tomoki Okura, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 17/352,624

(22) Filed: Jun. 21, 2021

(65) Prior Publication Data

US 2021/0398792 A1 Dec. 23, 2021

(30) Foreign Application Priority Data

Jun. 23, 2020 (JP) ..... JP2020-107802

(51) Int. Cl.

| | |
|---|---|
| ***H01J 61/04*** | (2006.01) |
| ***H01J 65/04*** | (2006.01) |
| ***H01J 61/30*** | (2006.01) |
| ***H01J 61/36*** | (2006.01) |
| ***H01J 61/067*** | (2006.01) |
| ***H01J 61/16*** | (2006.01) |

(52) U.S. Cl.

CPC ..... *H01J 65/042* (2013.01); *H01J 61/04* (2013.01); *H01J 61/0672* (2013.01); *H01J 61/16* (2013.01); *H01J 61/30* (2013.01); *H01J 61/361* (2013.01); *H01J 61/368* (2013.01)

(58) Field of Classification Search

CPC ..... H01J 61/30; H01J 61/361; H01J 61/368; H01J 61/04

USPC ..... 315/248

See application file for complete search history.

(56) References Cited

U.S. PATENT DOCUMENTS

| | | | | |
|---|---|---|---|---|
| 2008/0203912 | A1* | 8/2008 | Jinno | H01J 61/04 313/581 |
| 2011/0297844 | A1 | 12/2011 | Vecziedins et al. | |
| 2013/0093318 | A1* | 4/2013 | Panyik | H01J 61/36 313/631 |

FOREIGN PATENT DOCUMENTS

| | | | |
|---|---|---|---|
| JP | H7-220690 | A | 8/1995 |
| JP | H10-112290 | | 4/1998 |
| JP | 3090913 | B1 | 9/2000 |
| JP | 2001-325919 | A | 11/2001 |
| JP | 2005-347025 | A | 12/2005 |
| JP | 2008-010384 | | 1/2008 |
| JP | 2010-287417 | A | 12/2010 |

(Continued)

*Primary Examiner* — Christopher M Raabe

(74) *Attorney, Agent, or Firm* — Faegre Drinker Biddle & Reath LLP

(57) ABSTRACT

An excimer lamp includes a housing portion having a sealed internal space, an internal electrode, and a discharge gas with which the internal space is filled. One end side of the internal electrode is electrically connected to a power supply member provided with a metal foil electrically connected to the internal electrode and is sealed together with the power supply member to one end side of the housing portion via a sealing portion. The other end side of the internal electrode protrudes into the internal space. A protrusion length, being a length of the internal electrode in the internal space and a length from one end of the internal space to the other end of the internal electrode, is equal to or less than a length from the other end of the internal electrode to the other end of the internal space in a direction along the axis.

12 Claims, 4 Drawing Sheets

(56) References Cited

FOREIGN PATENT DOCUMENTS

| | | |
|---|---|---|
| JP | 2014-099386 | 5/2014 |
| JP | 2014-157671 A | 8/2014 |

* cited by examiner

EXCIMER LAMP

TECHNICAL FIELD

The present disclosure relates to an excimer lamp.

BACKGROUND

The dielectric barrier discharge lamp that is described in Japanese Unexamined Patent Publication No. H7-220690 is known as a technique relating to existing excimer lamps. The dielectric barrier discharge lamp described in Japanese Unexamined Patent Publication No. H7-220690 has a cylindrical outside electrode, an elongated inside electrode (internal electrode) coaxially disposed with a gap inside the outside electrode, and a cylindrical dielectric tube (housing portion) disposed between the two electrodes. The space between the outside electrode and the inside electrode is filled with a gas for discharge that forms excimer molecules by dielectric barrier discharge. One end side of the inside electrode is sealed to the cylindrical dielectric tube by the so-called graded seal method.

SUMMARY

As for the above-described technique, a region with high light emission intensity may decrease in the housing portion and a sufficient light output may not be obtained. In addition, a sealing portion that seals one end side of the internal electrode may be easily affected by the heat of the internal electrode and the heat may result in an increase in temperature and damage in the sealing portion.

An object of the present disclosure is to provide an excimer lamp capable of stably obtaining a sufficient light output.

An excimer lamp of one aspect of the present disclosure includes a tubular housing portion made of a light-transmitting material, extending along a predetermined axis, and having a sealed internal space, an internal electrode held on one end side of the housing portion and accommodated in the internal space, and a discharge gas with which the internal space is filled. One end side of the internal electrode is electrically connected to a power supply member provided with a metal foil electrically connected to the internal electrode and is sealed together with the power supply member to one end side of the housing portion via a sealing portion. The other end side of the internal electrode protrudes into the internal space. A protrusion length, being a length of the internal electrode in the internal space and a length from one end of the internal space to the other end of the internal electrode, is equal to or less than a length from the other end of the internal electrode to the other end of the internal space in a direction along the axis.

The present inventors have obtained the following findings as a result of diligent studies. In other words, the knowledge was obtained that a region having high light emission intensity can be sufficiently widened in the housing portion and a sufficient light output can be obtained when the protrusion length (hereinafter, also simply referred to as "protrusion length"), which is the length of the internal electrode in the internal space and the length from one end of the internal space to the other end of the internal electrode, is shortened to the length from the other end of the internal electrode to the other end of the internal space or less in the direction along the axis. Accordingly, it is possible to obtain a sufficient light output with one aspect of the present disclosure provided with the internal electrode having such a short protrusion length. On the other hand, when the protrusion length is short, it is found that the sealing portion becomes close from the tip portion that becomes particularly hot in the internal electrode and the temperature of the sealing portion is likely to increase. In this regard, in one aspect of the present disclosure, one end side of the internal electrode is electrically connected to the power supply member provided with the metal foil electrically connected to the internal electrode. Further, one end side of the internal electrode is sealed together with the power supply member to one end side of the housing portion via the sealing portion. As a result of this sealing, it is possible to have heat-resistant properties and the sealing portion is unlikely to be damaged even at a high temperature. Accordingly, it is possible to stably obtain a sufficient light output with one aspect of the present disclosure.

In the excimer lamp of one aspect of the present disclosure, the protrusion length may be ⅕ or more of a length of the internal space in the direction along the axis. When the protrusion length is less than ⅕ of the length of the internal space, it is found that the sealing portion becomes extremely hot because the protrusion length becomes excessively short and the sealing portion is more easily damaged while the light output is hard to change. Accordingly, it is possible to obtain a sufficient light output more stably when the protrusion length is ⅕ or more of the length of the internal space.

In the excimer lamp of one aspect of the present disclosure, a diameter of the internal electrode may be ⅕ or more and ½ or less of an inner diameter of the housing portion. Since the diameter of the internal electrode is ⅕ or more of the inner diameter of the housing portion, it is possible to suppress the internal electrode being thermally deformed and sagging even when the internal electrode has a cantilever structure held on one end side. In addition, since the diameter of the internal electrode is ½ or less of the inner diameter of the housing portion, it is possible to suppress the holding on one end side of the internal electrode becoming difficult.

In the excimer lamp of one aspect of the present disclosure, the power supply member may include a linear metal member electrically connected to the metal foil and led out to an outside of the housing portion, and a diameter of the linear metal member may be smaller than the diameter of the internal electrode. In this case, the linear metal member, which is susceptible to stress during manufacturing and use, is configured to be easily deformed and damage (such as cracks) to the sealing portion can be suppressed.

The excimer lamp of one aspect of the present disclosure may further include an external electrode abutting against an outer surface of the housing portion. In the excimer lamp of one aspect of the present disclosure, the external electrode may be provided so as to surround the outer surface of the housing portion and may have a mesh shape. In this case, it is possible to efficiently take the light out of the region of high light emission intensity widened in the housing portion.

The excimer lamp of one aspect of the present disclosure may further include a tubular socket made of an insulating material and surrounding one end side of the housing portion, and each of the power supply member and the external electrode may be electrically connected to an external power supply member in the socket. As a result, the power supply member and the external electrode can be respectively connected to the external power supply member in an electrically stable state.

In the excimer lamp of one aspect of the present disclosure, an electrical connection portion between the power supply member and the external power supply member and an electrical connection portion between the external electrode and the external power supply member may be separated from each other in the direction along the axis. As a result, the withstand voltage characteristic in the socket can be improved.

In the excimer lamp of one aspect of the present disclosure, the electrical connection portion between the external electrode and the external power supply member may be disposed in another end side opening portion in the socket. In many cases, the external electrode is the low potential side (for example, ground potential) for safety. Accordingly, when the portion of electrical connection to the external electrode is disposed in the other end side opening portion in the socket, the electrical connection portion between the internal electrode on the high potential side and the power supply member can be relatively disposed close to the middle in the socket in the direction along the axis. As a result, the withstand voltage characteristic in the socket can be improved.

In the excimer lamp of one aspect of the present disclosure, one end side of the external electrode may extend into the socket and may be fixed by a fixing member in the other end side opening portion in the socket. As a result, the external electrode can be reliably fixed and a stable discharge can be realized.

The excimer lamp of one aspect of the present disclosure may further include a lamp accommodating portion made of a metal material and including an insertion hole having an inner diameter corresponding to an outer diameter of the housing portion and a light emitting opening provided in the insertion hole. An external power supply member may be electrically connected to the lamp accommodating portion. In this case, the lamp accommodating portion is used as an external electrode and a sufficient light output can be stably obtained.

In the excimer lamp of one aspect of the present disclosure, the sealing portion may be a pinch seal portion sealing one end side of the internal electrode together with the power supply member to one end side of the housing portion with a pinch seal. In this case, the sealing portion can be configured by the heat-resistant pinch seal portion.

DETAILED DESCRIPTION

Figure 1:
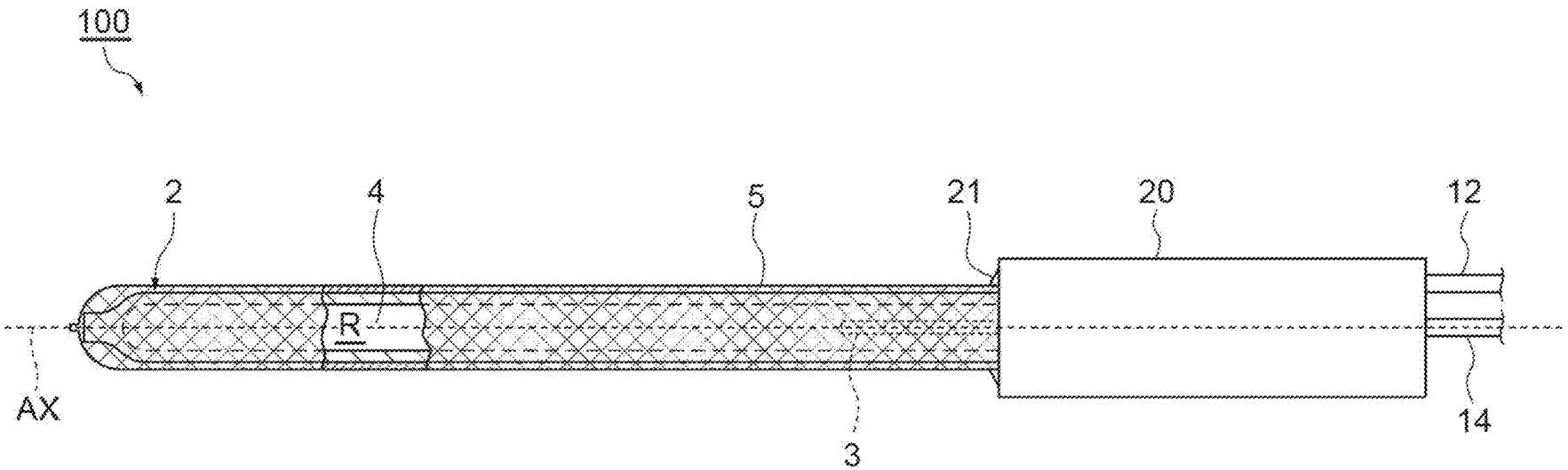
FIG. 1 is a front view illustrating the excimer lamp according to an embodiment.

Hereinafter, an embodiment of the present disclosure will be described in detail with reference to the drawings. It should be noted that the same reference numerals will be used for the same or equivalent elements in the following description and redundant description will be omitted. In addition, the dimensions in the following description do not necessarily correspond to the drawings.

Figure 2:
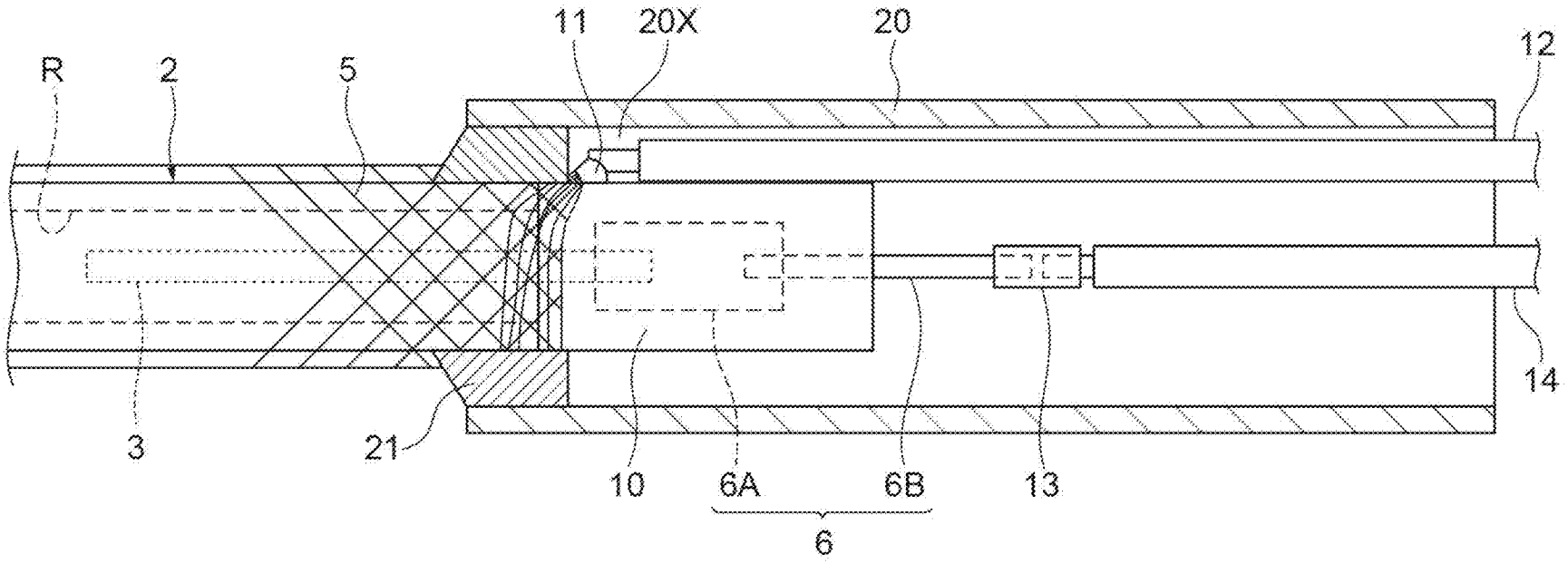
FIG. 2 is a partial cross-sectional front view in which the excimer lamp of FIG. 1 is enlarged.
Figure 3A:
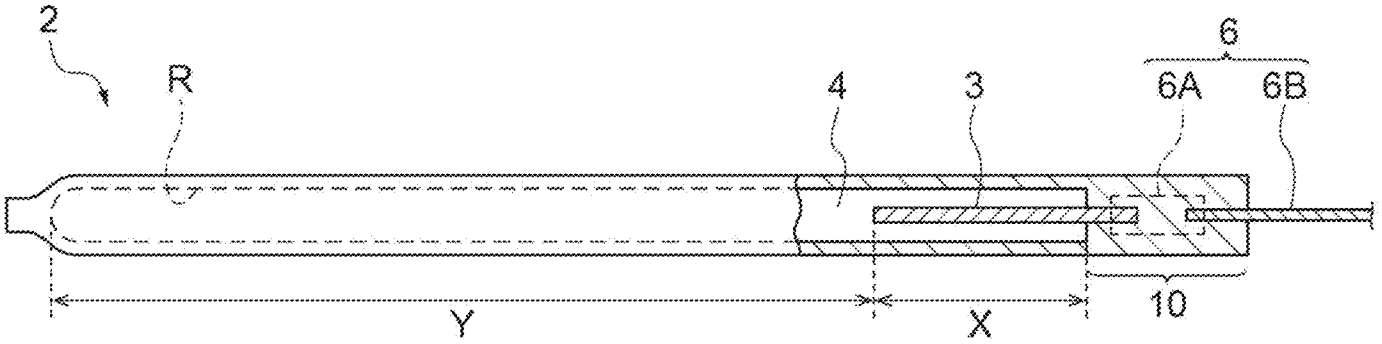
FIG. 3A is a partial cross-sectional front view illustrating a main portion of the excimer lamp of FIG. 1.
Figure 3B:
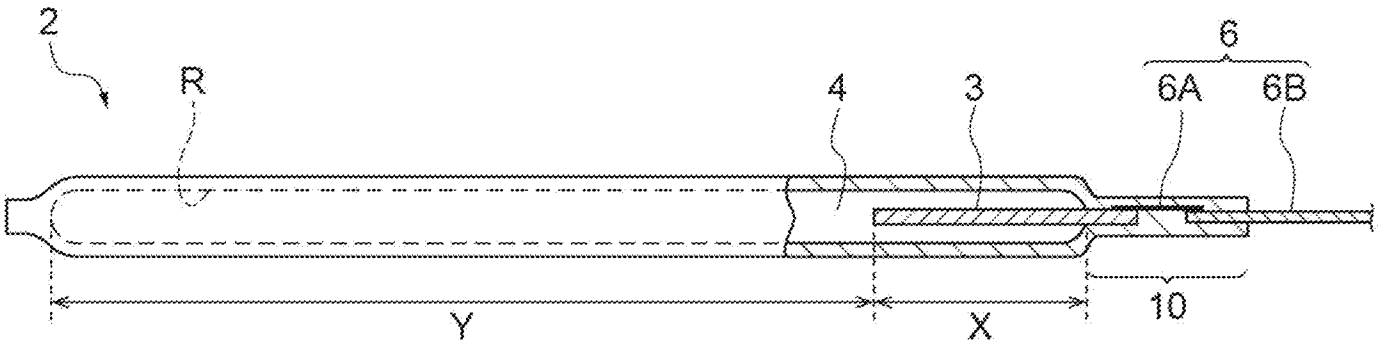
FIG. 3B is a partial cross-sectional plan view illustrating the main portion of the excimer lamp of FIG. 1.

FIG. 1 is a side view illustrating an excimer lamp 100 according to the embodiment. FIG. 2 is a partial cross-sectional front view in which one end side of a housing portion 2 in the excimer lamp 100 is enlarged. FIG. 3A is a partial cross-sectional front view illustrating a main portion of the excimer lamp 100. FIG. 3B is a partial cross-sectional plan view illustrating the main portion of the excimer lamp 100. As illustrated in FIGS. 1 and 2, the excimer lamp 100 is a discharge lamp that radiates excimer light (vacuum ultraviolet light) by using discharge plasma (such as discharge plasma by dielectric barrier discharge). The excimer lamp 100 includes the housing portion 2, an internal electrode 3, a discharge gas 4, an external electrode 5, and a power supply member 6.

The housing portion 2 constitutes a dielectric in dielectric barrier discharge. The housing portion 2 has a circular tube shape extending from one end side (right side in the drawing) to the other end side (left side in the drawing) along a predetermined axis AX (hereinafter, also simply referred to as "axis AX"). In the present embodiment, the central axis of the housing portion 2 is coaxial with the axis AX. The housing portion 2 is made of, for example, synthetic quartz glass, which is a light-transmitting material and an insulating material. The housing portion 2 has a pinch seal portion 10 on one end side thereof. One end side of the housing portion 2 is airtightly sealed by the pinch seal portion 10. In addition, the other end side of the housing portion 2 is airtightly sealed by sealing. As a result, the housing portion 2 has a sealed internal space R. The internal space R is a columnar space, the axis AX is the central axis of the internal space R, and the internal space R has a diameter of, for example, 4 mm.

The internal electrode 3 is made of, for example, a wire rod made of tungsten and having a diameter of 1.2 mm. The internal electrode 3 linearly extends along the axis AX. The internal electrode 3 is held on one end side of the housing portion 2 and is accommodated in the internal space R such that the central axis in the extension direction thereof substantially coincides with the central axis (axis AX) of the internal space R. The discharge gas 4 is a rare gas for discharge with which the internal space R is filled. Xenon gas or the like is used as the discharge gas 4.

The external electrode 5 is fixed in a state of abutting against the outer surface of the housing portion 2. The external electrode 5 is made of nickel. The external electrode 5 extends along the axis AX and is provided so as to surround substantially the entire outer surface of the housing portion 2. The external electrode 5 is a net electrode having a mesh shape and a circular tube shape. The other end side of the external electrode 5 is closed by fusing. One end side of the external electrode 5 is electrically connected to a conducting wire (external power supply member) 12 by solder (fixing member and electrical connection portion) 11 on the outer surface of the housing portion 2 (pinch seal portion 10) in a bundled and bound state. The conducting wire 12 extends along the axis AX.

The power supply member 6 is a member for supplying power to the internal electrode 3. The power supply member 6 has a metal foil 6A and a linear metal member 6B. The metal foil 6A is a foil-shaped metal member made of, for example, molybdenum and has a rectangular shape. One end side of the internal electrode 3 is welded to the other end side of the metal foil 6A. As a result, one end side of the internal electrode 3 is electrically connected to the metal foil 6A. The linear metal member 6B is made of, for example, molybdenum and linearly extends along the axis AX. The other end side of the linear metal member 6B is welded to one end side of the metal foil 6A. As a result, one end side of the metal foil 6A is electrically connected to the linear metal member 6B. The diameter of the linear metal member 6B is smaller than the diameter of the internal electrode 3. In addition, the thickness of the metal foil 6A as a foil is smaller than the diameter of the internal electrode 3 and the diameter of the linear metal member 6B. One end side of the linear metal member 6B is led out to the outside of the housing portion 2. One end side of the linear metal member 6B is electrically connected to a conducting wire (external power supply member) 14 via a connecting member 13 (electrical connection portion) made of, for example, nickel. The conducting wire 14 extends along the axis AX.

As illustrated in FIGS. 2, 3A, and 3B, in the present embodiment, one end side of the internal electrode 3 is sealed together with the power supply member 6 to one end side of the housing portion 2 via the pinch seal portion 10. The pinch seal portion 10 is a sealing portion that seals one end side of the internal electrode 3 together with the power supply member 6 to one end side of the housing portion 2 with a pinch seal. The pinch seal is a method for performing sealing by applying force from the outside while performing heating. The pinch seal portion 10 is a part that has a flat shape on one end side of the housing portion 2. One end side of the internal electrode 3, the metal foil 6A, and the other end side of the linear metal member 6B are embedded in the pinch seal portion 10. The pinch seal portion 10 holds the internal electrode 3 in a cantilever structure.

The other end side of the internal electrode 3 protrudes into the internal space R. As illustrated in FIGS. 3A and 3B, in the direction along the axis AX, a protrusion length X which is the length of the internal electrode 3 in the internal space R and the length from one end of the internal space R to the other end of the internal electrode 3 (hereinafter, also simply referred to as "protrusion length X") is equal to or less than the length from the other end of the internal electrode 3 to the other end of the internal space R. Specifically, in the direction along the axis AX, the protrusion length X is ⅕ or more of the length of the internal space R. For example, the protrusion length X may be 15 mm when the length of the internal space R is approximately 80 mm in the direction along the axis AX. The diameter of the internal electrode 3 is ⅕ or more and ½ or less of the inner diameter of the housing portion 2 (diameter of the internal space R).

As illustrated in FIGS. 1 and 2, the excimer lamp 100 includes a socket 20. The socket 20 is made of an insulating material and is made of, for example, alumina. The socket 20 has a cylindrical shape that surrounds one end side of the housing portion 2. In the socket 20, the external electrode 5 and the power supply member 6 are electrically connected to the conducting wires 12 and 14, respectively. The other end side of the socket 20 is fixed to the outer surface of the other end side of the pinch seal portion 10 in the housing portion 2 and the part close thereto by an insulating resin (such as an alumina-based inorganic adhesive) 21. It should be noted that the shape of the socket 20 is not limited to the cylindrical shape and may be a tubular shape. In FIG. 2, the socket 20 and the insulating resin 21 are illustrated in cross sections.

The connecting member 13, which is the electrical connection portion between the power supply member 6 and the conducting wire 14, and the solder 11, which is the electrical connection portion between the external electrode 5 and the conducting wire 12, are separated from each other in the direction along the axis AX. The solder 11 is disposed in an opening portion 20X on the other end side, which is the opening side part (end portion) on the other end side in the socket 20. One end side of the external electrode 5 extends into the socket 20 and is fixed by the solder 11 in the other end side opening portion 20X in the socket 20. The solder 11 constitutes the fixing member.

In the excimer lamp 100 described above, multiple discharge plasmas attributable to dielectric barrier discharge are generated in the internal space R when, for example, a high AC voltage is applied to the internal electrode 3 and the external electrode 5. The discharge plasma excites the atoms of the discharge gas 4 and an excimer state occurs instantaneously. Light is emitted (excimer light emission) during a return from the excimer state to the original state (ground state). As a result, excimer light (here, vacuum ultraviolet light) is released.

Here, it is possible to obtain the knowledge that a light emitting region having high light emission intensity can be sufficiently widened in the housing portion 2 and a sufficient light output can be obtained when the protrusion length X is shortened to a length Y from the other end of the internal electrode 3 to the other end of the internal space R or less in the direction along the axis AX. Accordingly, it is possible to obtain a sufficient light output with the excimer lamp 100 provided with the internal electrode 3 having such a short protrusion length X. On the other hand, when the protrusion length X is short, the pinch seal portion 10 becomes close from the tip portion that becomes particularly hot in the internal electrode 3, the temperature of the pinch seal portion 10 is likely to increase, and the pinch seal portion 10 may be easily damaged. In this regard, in the excimer lamp 100, one end side of the internal electrode 3 is electrically connected to the power supply member 6 provided with the metal foil 6A electrically connected to the internal electrode 3. Further, one end side of the internal electrode 3 is sealed together with the power supply member 6 to one end side of the housing portion 2 via the pinch seal portion 10. As a result of this sealing, it is possible to have heat-resistant properties and the pinch seal portion 10 is unlikely to be damaged even at a high temperature.

In other words, in the excimer lamp 100 of the present embodiment provided with the internal electrode 3 having a cantilever structure in the tubular housing portion 2, one end side of the internal electrode 3 is sealed and fixed by the pinch seal portion 10 and the protrusion length X of the internal electrode 3 is half or less of the internal space R in the direction along the axis AX. With the excimer lamp 100, it is possible to stably obtain a sufficient light output.

In the excimer lamp 100, the protrusion length X is ⅕ or more of the length of the internal space R in the direction along the axis AX. When the protrusion length X is less than ⅕ of the length of the internal space R, it is found that the pinch seal portion 10 becomes extremely hot because the protrusion length X becomes excessively short and the pinch seal portion 10 is more easily damaged while the light output is hard to change. Accordingly, it is possible to obtain a sufficient light output more stably when the protrusion length X is ⅕ or more of the length of the internal space R.

In the excimer lamp 100, the diameter of the internal electrode 3 is ⅕ or more and ½ or less of the inner diameter of the housing portion 2. Since the diameter of the internal electrode 3 is ⅕ or more of the inner diameter of the housing portion 2, it is possible to suppress the internal electrode 3 being thermally deformed and sagging even when the internal electrode 3 has a cantilever structure held on one end side. In addition, since the diameter of the internal electrode 3 is ½ or less of the inner diameter of the housing portion 2, it is possible to suppress the holding on one end side of the internal electrode 3 becoming difficult. For example, it is possible to suppress the impact of the thermal expansion of the internal electrode 3 (for example, such as damage to the pinch seal portion 10). In addition, when the internal electrode 3 becomes too thick, for example, the aspect ratio deteriorates at the one end side part that is held and the pinch seal portion 10 may easily crack or the internal electrode 3 may easily escape when, for example, the internal electrode 3 vibrates. However, this possibility can be suppressed since the diameter of the internal electrode 3 is ½ or less of the inner diameter of the housing portion 2. Accordingly, it is possible to obtain a stable discharge state. There is no need to increase the length of one end side held in the internal electrode 3 (length of embedding in the housing portion 2), and the excimer lamp 100 can be reduced in size.

In the excimer lamp 100, the power supply member 6 includes the linear metal member 6B electrically connected to the metal foil 6A and led out to the outside of the housing portion 2 in addition to the metal foil 6A electrically connected to the internal electrode 3. The diameter of the linear metal member 6B is smaller than the diameter of the internal electrode 3. In this case, the linear metal member 6B, which is susceptible to stress during manufacturing and use, is configured to be easily deformed and damage (such as cracks) to the pinch seal portion 10 can be suppressed. In other words, even when a slightly unreasonable force is applied to the linear metal member 6B, for example, the possibility of cracking of the pinch seal portion 10 decreases simply by the linear metal member 6B being bent.

The excimer lamp 100 includes the external electrode 5 abutting against the outer surface of the housing portion 2. In the excimer lamp 100, the external electrode 5 is provided so as to surround the outer surface of the housing portion 2 and has a mesh shape. In this case, the excimer light can be efficiently taken out of the wide light emitting region in the housing portion 2.

The excimer lamp 100 includes the socket 20. In the socket 20, the power supply member 6 and the external electrode 5 are electrically connected to the conducting wires 14 and 12, respectively. As a result, the power supply member 6 and the external electrode 5 can be respectively connected to the conducting wires 14 and 12 in an electrically stable state.

In the excimer lamp 100, the connecting member 13 and the solder 11 are separated from each other in the direction along the axis AX. As a result, in the excimer lamp 100, the withstand voltage characteristic in the socket 20 can be improved.

In the excimer lamp 100, the external electrode 5 is the low potential side (for example, ground potential) for safety. In addition, the solder 11, which is the portion of electrical connection to the external electrode 5, is disposed in the other end side opening portion 20X in the socket 20 and the connecting member 13, which is the electrical connection portion between the internal electrode 3 on the high potential side and the power supply member 6, is relatively disposed close to the middle in the socket 20 in the direction along the axis AX. Accordingly, in the excimer lamp 100, the withstand voltage characteristic in the socket 20 can be improved.

In the excimer lamp 100, one end side of the external electrode 5 extends into the socket 20 and is fixed by the solder 11 in the other end side opening portion 20X in the socket 20. As a result, the external electrode 5 can be reliably fixed and a stable discharge can be realized.

The excimer lamp 100 includes, as a sealing portion, the pinch seal portion 10 that seals one end side of the internal electrode 3 together with the power supply member 6 to one end side of the housing portion 2 with a pinch seal. In this case, the sealing portion can be configured by the heat-resistant pinch seal portion 10.

Table 1 below shows the result of excimer lamp light output measurement at a time when the protrusion length X of the internal electrode 3 is changed. In the measurement here, the light output at a time when the protrusion length X of the internal electrode 3 was changed to 10 mm, 15 mm, 30 mm, 45 mm, 60 mm, and 75 mm was measured by means of an actinometer. It should be noted that the various measurement conditions are based on general measurement test conditions. In the direction along the axis AX, the light emitting region from one end side to the other end side in the housing portion 2 was divided into five, that is, root, rear, middle rear, middle front, and front portions in the order from one end side to the other end side. The sum is the total value of the light outputs of the five light emitting regions. The internal space R had a total length of approximately 80 mm.

According to Table 1 below, it can be seen that the total light output is insufficient although the protrusion length X decreases and thus an increase in light output that is equal to or greater than the rate of increase in input current is seen while the protrusion length X of the internal electrode 3 is long with respect to the total length of the internal space R. Further, it can be seen that the rate of increase in light output temporarily decreases as the protrusion length X of the internal electrode 3 decreases and yet the increase in light output increases again and the total light output becomes sufficient from a case where the protrusion length X is approximately ½ with respect to the total length of the internal space R. It can be seen that it is possible to obtain a sufficient light output in the present embodiment in which the protrusion length X is ½ or less of the internal space R. It can be seen that the light output is substantially the same as when the protrusion length X is 15 mm when the protrusion length X is 10 mm, which is less than ⅕ of the length of the internal space R.

TABLE 1

| Protrusion length of internal electrode | Light output ($mW/cm^2$) Root portion | Rear portion | Middle rear portion | Middle front portion | Front portion | Sum | Input current (A) |
|---|---|---|---|---|---|---|---|
| 10 mm (shortest) | 14.3 | 19.2 | 21.4 | 23.5 | 23.5 | 101.9 | 0.53 |
| 15 mm | 16.1 | 20.9 | 19.2 | 20.5 | 25.4 | 102.1 | 0.51 |
| 30 mm | 6.2 | 10.5 | 20.4 | 19.3 | 23.4 | 79.8 | 0.49 |
| 45 mm | 8.5 | 11.0 | 13.9 | 13.6 | 22.6 | 69.6 | 0.46 |
| 60 mm | 7.2 | 12.4 | 12.5 | 11.7 | 22.6 | 66.4 | 0.43 |
| 75 mm (longest) | 7.2 | 9.2 | 12.0 | 13.1 | 14.7 | 56.2 | 0.40 |

Although the embodiment has been described above, one aspect of the present disclosure is not limited to the above embodiment.

Figure 4A:
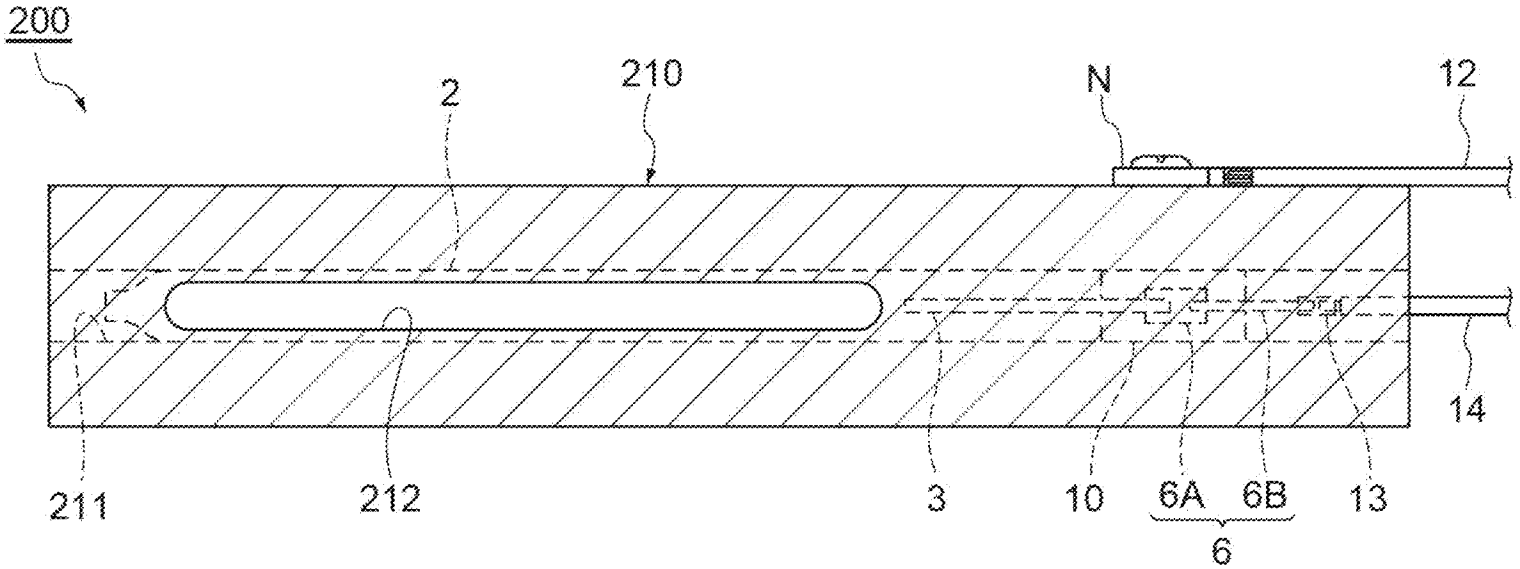
FIG. 4A is a front view illustrating the excimer lamp according to a modification example.
Figure 4B:
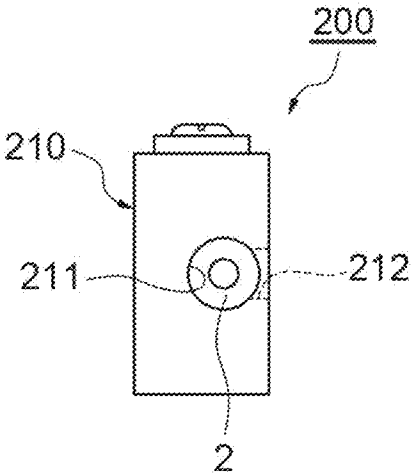
FIG. 4B is a left side view illustrating the excimer lamp of FIG. 4A.

FIGS. 4A and 4B are views illustrating an excimer lamp 200 according to a modification example. As illustrated in FIGS. 4A and 4B, one aspect of the present disclosure may be the excimer lamp 200. The excimer lamp 200 is different from the above embodiment mainly in that a lamp accommodating portion 210 is provided instead of the external electrode 5 (see FIG. 1).

The lamp accommodating portion 210 is a member made of a metal material and having a rectangular parallelepiped outer shape. The other end side of the conducting wire 12 is fixed to the outer surface of the lamp accommodating portion 210 by means of a screw N. As a result, the lamp accommodating portion 210 is electrically connected to the conducting wire 12. The lamp accommodating portion 210 includes an insertion hole 211 and a light emitting opening 212 provided in the insertion hole 211.

The insertion hole 211 is a through hole having a circular cross section and extending along the axis AX. The insertion hole 211 has an inner diameter corresponding to the outer diameter of the housing portion 2. The insertion hole 211 here has an inner diameter substantially equal to the outer shape of the housing portion 2, and thus at least a part of the inner surface of the insertion hole 211 abuts against the outer surface of the housing portion 2. In addition, the inner surface of the insertion hole 211 is a surface reflecting excimer light. The insertion hole 211 accommodates the housing portion 2, the power supply member 6, the connecting member 13, and the other end side of the conducting wire 14. The light emitting opening 212 communicates with the insertion hole 211 and opens in a direction orthogonal to the axis AX. As for the light emitting opening 212 in the direction along the axis AX, the region of the discharge region in the housing portion 2 accommodated in the insertion hole 211 that excludes the region of disposition of the internal electrode 3 and the other end portion tip region, the region from the position near one end of the middle portion to the front of the other end to be more specific, is exposed. In the excimer lamp 200 according to the modification example, the lamp accommodating portion 210 is used as an external electrode and a sufficient light output can be stably obtained. In addition, the generated excimer light is reflected on the light emitting opening 212 side and a large amount of excimer light can be obtained from the light emitting opening 212.

Although the housing portion 2 and the external electrode 5 have a circular tube shape in the above-described embodiment and the above-described modification example, the shapes of the housing portion 2 and the external electrode 5 are not limited to the circular tube shape and may be a tubular shape. The diameter of the internal electrode 3 may be the diameter of a circle in which the cross-sectional shape of the outer shape of the internal electrode 3 is inscribed. The inner diameter of the housing portion 2 may be the diameter of a circle in which the cross-sectional shape of the internal space R is inscribed. The outer diameter of the housing portion 2 may be the diameter of a circle in which the cross-sectional shape of the outer shape of the internal electrode 3 is inscribed. The diameter of the linear metal member 6B may be the diameter of a circle in which the cross-sectional shape of the outer shape of the linear metal member 6B is inscribed.

In the above-described embodiment and the above-described modification example, the diameter of the internal electrode 3 may be a maximum diameter, a minimum diameter, an average diameter, or the diameter of a main part thereof. The inner diameter of the housing portion 2 (diameter of the internal space R) may be a maximum diameter, a minimum diameter, an average diameter, or the diameter of a main part thereof. The outer diameter of the housing portion 2 may be a maximum diameter, a minimum diameter, an average diameter, or the diameter of a main part thereof. The diameter of the linear metal member 6B may be a maximum diameter, a minimum diameter, an average diameter, or the diameter of a main part thereof. The inner diameter of the insertion hole 211 may be a maximum diameter, a minimum diameter, an average diameter, or the diameter of a main part thereof.

Various materials and shapes can be applied, without being limited to the materials and shapes described above, to the configurations in the above-described embodiment and the above-described modification example. Each configuration in the above-described embodiment or modification example can be freely applied to each configuration in another embodiment or modification example. A part of each configuration in the above-described embodiment or modification example can be appropriately omitted without departing from the gist of one aspect of the present disclosure.

According to the present disclosure, it is possible to provide an excimer lamp capable of stably obtaining a sufficient light output.

What is claimed is:

1. An excimer lamp comprising:

a tubular housing portion made of a light-transmitting material, extending along a predetermined axis, and having a sealed internal space;

an internal electrode held on one end side of the housing portion and accommodated in the internal space; and a discharge gas with which the internal space is filled, wherein one end side of the internal electrode is electrically connected to a power supply member provided with a metal foil electrically connected to the internal electrode and is sealed together with the power supply member to one end side of the housing portion via a sealing portion, the other end side of the internal electrode protrudes into the internal space, and a protrusion length, being a length of the internal electrode in the internal space and a length from one end of the internal space to the other end of the internal electrode, is equal to or less than a length from the other end of the internal electrode to the other end of the internal space in a direction along the axis.

2. The excimer lamp according to claim 1, wherein the protrusion length is ⅕ or more of a length of the internal space in the direction along the axis.

3. The excimer lamp according to claim 1, wherein a diameter of the internal electrode is ⅕ or more and ½ or less of an inner diameter of the housing portion.

4. The excimer lamp according to claim 1, wherein the power supply member includes a linear metal member electrically connected to the metal foil and led out to an outside of the housing portion, and a diameter of the linear metal member is smaller than the diameter of the internal electrode.

5. The excimer lamp according to claim 1, further comprising an external electrode abutting against an outer surface of the housing portion.

6. The excimer lamp according to claim 5, wherein the external electrode is provided so as to surround the outer surface of the housing portion and has a mesh shape.

7. The excimer lamp according to claim 5, further comprising a tubular socket made of an insulating material and surrounding one end side of the housing portion, wherein each of the power supply member and the external electrode is electrically connected to an external power supply member in the socket.

8. The excimer lamp according to claim 7, wherein an electrical connection portion between the power supply member and the external power supply member and an electrical connection portion between the external electrode and the external power supply member are separated from each other in the direction along the axis.

9. The excimer lamp according to claim 7, wherein the electrical connection portion between the external electrode and the external power supply member is disposed in another end side opening portion in the socket.

10. The excimer lamp according to claim 9, wherein one end side of the external electrode extends into the socket and is fixed by a fixing member in the other end side opening portion in the socket.

11. The excimer lamp according to claim 1, further comprising a lamp accommodating portion made of a metal material and including an insertion hole having an inner diameter corresponding to an outer diameter of the housing portion and a light emitting opening provided in the insertion hole, wherein an external power supply member is electrically connected to the lamp accommodating portion.

12. The excimer lamp according to claim 1, wherein the sealing portion is a pinch seal portion sealing one end side of the internal electrode together with the power supply member to one end side of the housing portion with a pinch seal.

* * * * *